US006588064B2

(12) United States Patent
Baum

(10) Patent No.: US 6,588,064 B2
(45) Date of Patent: Jul. 8, 2003

(54) DETACHABLE CUP HANDLE

(76) Inventor: Arnold Baum, 60 Devonshire Rd., New Rochelle, NY (US) 10804

( * ) Notice: Subject to any disclaimer, the term of this patent is extended or adjusted under 35 U.S.C. 154(b) by 2 days.

(21) Appl. No.: 10/054,071

(22) Filed: Nov. 13, 2001

(65) Prior Publication Data

US 2003/0088945 A1 May 15, 2003

(51) Int. Cl.[7] ..... A47J 45/00; A45C 13/22

(52) U.S. Cl. ..... 16/422; 16/425; 294/27.1; 294/33

(58) Field of Search ..... 16/422, 425; 294/27.1, 294/29, 31.1, 32; 220/737, 738, 758, 759, 768, 769; D7/619–622, 393–395

(56) References Cited

U.S. PATENT DOCUMENTS

| | | | | | |
|---|---|---|---|---|---|
| 902,236 | A | * | 10/1908 | Kintz | 215/396 |
| 1,133,420 | A | * | 3/1915 | Young | 294/33 |
| 2,029,429 | A | | 2/1936 | Koons | 16/114 |
| 2,630,244 | A | | 3/1953 | Brock | 220/94 |
| 2,639,502 | A | * | 5/1953 | Wormelle, Jr. | 30/450 |
| D195,985 | S | | 8/1963 | Scherrer et al. | D44/29 |
| 3,261,633 | A | | 7/1966 | Sakuta | 294/16 |
| 3,825,151 | A | * | 7/1974 | Arnaud | 220/742 |
| 3,867,738 | A | * | 2/1975 | Garner | 294/27.1 |
| D251,175 | S | * | 2/1979 | Logan et al. | D7/619 |
| D254,417 | S | * | 3/1980 | DeMars et al. | 294/33 |
| 4,898,297 | A | * | 2/1990 | Wheeler | 220/742 |
| 5,203,471 | A | * | 4/1993 | Widman | 220/755 |
| 5,558,570 | A | * | 9/1996 | Nakamura et al. | 451/357 |
| 5,788,298 | A | | 8/1998 | Cheng | 294/27.1 |

* cited by examiner

*Primary Examiner*—Chuck V. Mah
(74) *Attorney, Agent, or Firm*—Darby & Darby

(57) ABSTRACT

A detachable cup handle is provided and is constructed to be conveniently and detachably fastened to a cup. The detachably cup handle is also advantageously reusable. The detachable cup handle includes a curved hand grip section for holding by the user's hand, a vertical support section to support the hand grip section, and a retainer section for clamping on a rim of the cup. The retainer section includes a clamping wall portion for engaging a rim of the cup so as to interlockingly couple the detachable cup handle to the cup's rim. The clamping wall portion has a tapered construction for providing additional cup gripping/clamping means. In addition, the support section includes opposing arcuate support members to cradle the cup's body.

27 Claims, 4 Drawing Sheets

DETACHABLE CUP HANDLE

TECHNICAL FIELD

The present invention relates to a detachable cup handle adapted for securing to a disposable cup to make it more convenient for carrying by hand. The detachable cup handle provides stability while the cup is held in the hand, prevents heat transfer to the hand of the user, and is reusable.

BACKGROUND

In hospitals, offices, factories, public facilities, etc., disposable paper or plastic cups are frequently provided for holding drinking water from, for example, a drinking fountain. In order to minimize manufacturing cost and the complexity of the manufacturing process, traditional disposable cups do not have a handle for carrying. A disposable cup with no handle is not suitable for holding hot beverages, because heat is directly transmitted through the thin wall of the cup to the user's hand, causing discomfort to the user's hand or even scalding.

Examples of patents directed generally to snap-on or detachable cup holders are U.S. Pat. Nos. 1,133,420; 2,029,429; 2,630,244; 5,788,298 and Des. 195,985. All cited patents are hereby incorporated herein by reference.

Desirable properties in a detachable cup handle are ease of attachment and detachment, stability of the cup while drinking, and low cost of manufacture. Detachable cup handles known in the art are deficient in one or more of these properties. In particular, detachable cup handles that are known in the art fail to apply a secure grip to the cup rim to which they are attached, while at the same time allowing for easy detachment and reuse of the cup handle. Furthermore, cup handles known in the art fail to provide adequate support to a cup while it is being lifted and used for drinking. These deficiencies cause a heavy cup of liquid to become unstable and slip while being raised and tilted to the lips of the drinker. As a result, during use of known detachable cup handles, liquid may splash or spill on the drinker, or the cup may be released from the detachable cup handle and drop. Thus, there is a need in the art for detachable cup handles with improved stability in handling heavy cups of liquid while drinking.

SUMMARY OF THE INVENTION

A detachable cup handle is provided and is constructed to be conveniently and detachably fastened to a cup to make the cup more convenient for carrying by hand. Accordingly, a consumer can attach the detachable cup handle to the cup, thereby eliminating the need to grasp the cup by the cup body which can obtain high temperatures (or low temperatures) due to the temperature of the medium contained in the cup. The detachable cup handle may be used on cups with or without covers, and is reusable.

According to one embodiment, the detachable cup handle includes a curved hand grip section for holding by the user's hand, a vertical support section to support the hand grip section, and a retainer section for clamping on a rim of the cup. The detachable cup handle includes additional support and retainer features compared to similar conventional devices. By forming a clamping wall portion of the support section with a tapered wing-shaped construction, additional cup gripping/clamping means is provided to ensure that the detachable cup handle is securely fastened to the cup rim. Advantageously, this ensures that the handle is adapted to carry increased loads within the cup, thereby reducing or entirely eliminating the lack of stability problems that are associated with conventional cup handles. By increasing the overall gripping interface between the detachable cup handle and the cup, the handle is capable of carrying heavier loads (i.e., more volume of liquid in the cup).

Furthermore, the support section includes additional support features for dispersing a load that is applied to the support section during use. In other words, the load is dispersed over a greater area of the cup body. In one embodiment, these additional features are in the form of first and second arcuate support members that extend latitudinally from a vertical support member of the support section. These first and second arcuate support members form a latitudinal cross-bar that cradles the body of the cup. This provides additional support to the handle and disperses the load more effectively when the user raises and tips the cup for drinking. Because the first and second arcuate support members have a complementary shape with respect to the shape of the cup body, these arcuate support members serve to locate the cup relative to the detachable cup handle so that the detachable cup handle securely engages and is fastened to the cup at a predetermined location. The first and second arcuate support members prevent the detachable cup handle from inadvertently slipping or moving during a drinking action. The detachable cup handle is detached from the cup rim by exerting pressure against the clamping wall portion in the direction away from the cup wall. Hence, the detachable cup holder is reusable.

Further aspects and features of the exemplary detachable cup handle disclosed herein can be appreciated from the appended Figures and accompanying written description.

DETAILED DESCRIPTION OF A PREFERRED EMBODIMENT

Figure 1:
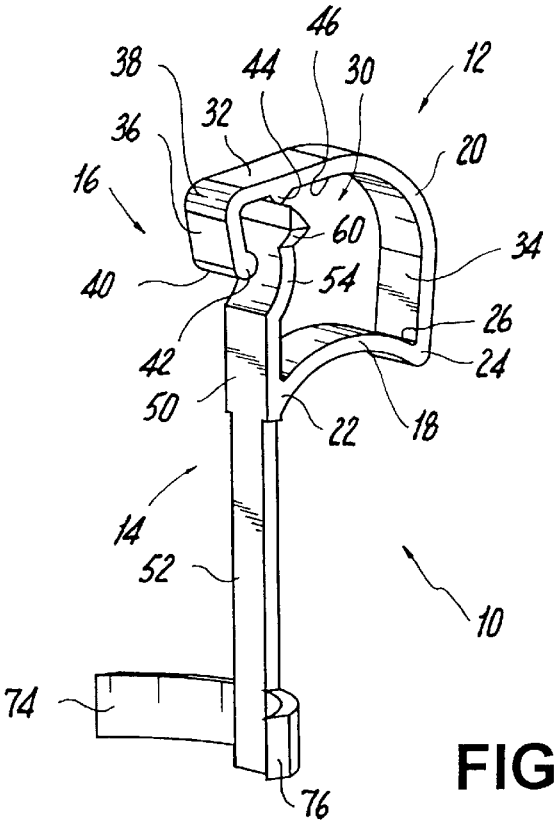
FIG. 1 is a front perspective view of a detachable cup handle in accordance with one embodiment.

Referring to FIGS. 1 through 4, a detachable cup handle in accordance with one embodiment is generally indicated at 10. The detachable cup handle 10 is adapted for securing to a cup, such as a disposable cup, to better facilitate carrying of the cup by the detachable cup handle 10 instead of carrying by grasping the cup body itself. The detachable cup handle 10 includes a hand grip section 12, a support section 14, and a retainer section 16. The detachable cup handle 10 can be formed of any number of materials, such as a plastic material, and preferably, the detachable cup handle 10 is formed as a single integral member. One particularly preferred method of making the detachable cup handle 10 is an injection molding process due to the relatively low manufacturing costs associated with injection molding.

The hand grip section 12 acts as a portion of the detachable cup handle 10 that a user can grip and hold a cup (not shown) once the detachable cup handle 10 is attached to the cup, as will be described in greater detail hereinafter. The hand grip section 12 includes an arcuate wall 18 and a curved wall 20 with the arcuate wall 18 having a first connecting portion 22 integrally connected to the support section 14 and a second connecting portion 24 that is integrally connected to a second connecting portion 26 of the curved wall 20. The arcuate wall 18 is preferably configured so that the user can rest one side of the user's middle finger against the lower surface of the arcuate wall 18. Accordingly, the arcuate wall 18 is preferably shaped and dimensioned so as to accomplish this result. A space 30 is defined between the support section 14, the arcuate wall 18 and the curved wall 20. This space 30 is for receiving the forefinger (index finger) when the user grips the detachable cup handle 10 and therefore should be sufficiently sized to permit the user's forefinger to extend therethrough.

The curved wall 20 has a generally planar upper support surface 32 for resting the user's thumb. A lower section 34 of the curved wall 20 that terminates in the second connection portion 26 is likewise a generally planar surface.

The curved wall 20 is also integral to elements of the retainer section 16. More specifically, the retainer section 16 includes a substantially vertical wall 36 that has a first connecting portion 38 and a distal end 40. The first connecting portion 38 connects the vertical wall 36 to the planar upper support surface 32 of the curved wall 20. The distal end 40 terminates in a clamping rib 42 that faces inwardly towards the rear face of the curved wall 20. The retainer section 16 also includes a transverse rib 44 formed on an inner surface 46 of the curved wall 20. The transverse rib 44 is spaced from the connecting portion 38 so as to define a space 48 between the vertical wall 36 and the transverse rib 44.

The support section 14 has a first section 50 that extends above the first connecting portion 22 where the arcuate wall 18 joins the support section 14 and a second section 52 that extends below the first connecting portion 22. An upper end of the first section 50 terminates in a substantially arched clamping wall portion 54. The clamping wall portion 54 is inserted into the space 48 defined between the vertical wall 36 and the transverse rib 44. When the detachable cup holder 10 is in a rest position (not attached to the cup), the clamping wall portion 54 rests between the vertical wall 36 and the transverse rib 44.

Figure 2:
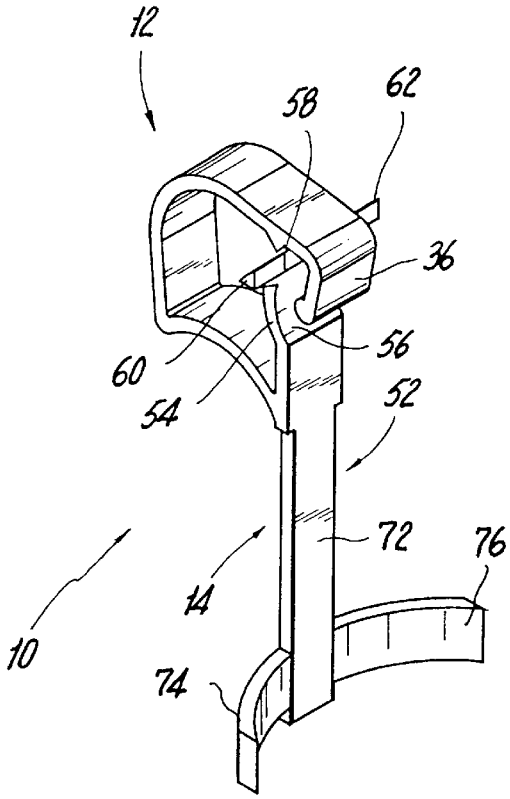
FIG. 2 is a front perspective view at a different angle of the detachable cup handle of FIG. 1.
Figure 3:
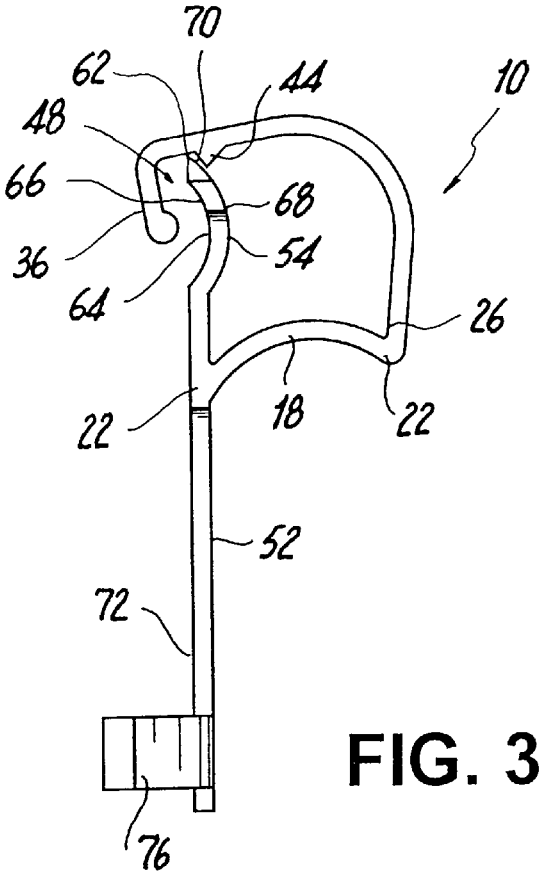
FIG. 3 is a side elevational view of the detachable cup handle of FIG. 1.
Figure 4:
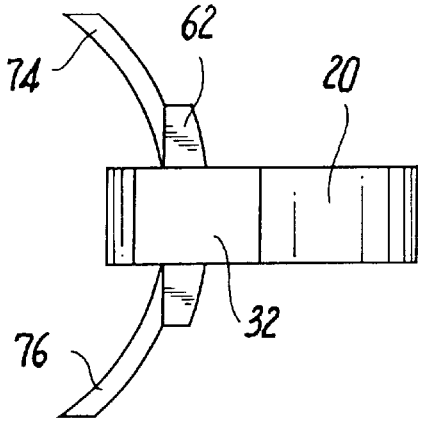
FIG. 4 is a top plan view of the detachable cup handle of FIG. 1.
Figure 5:
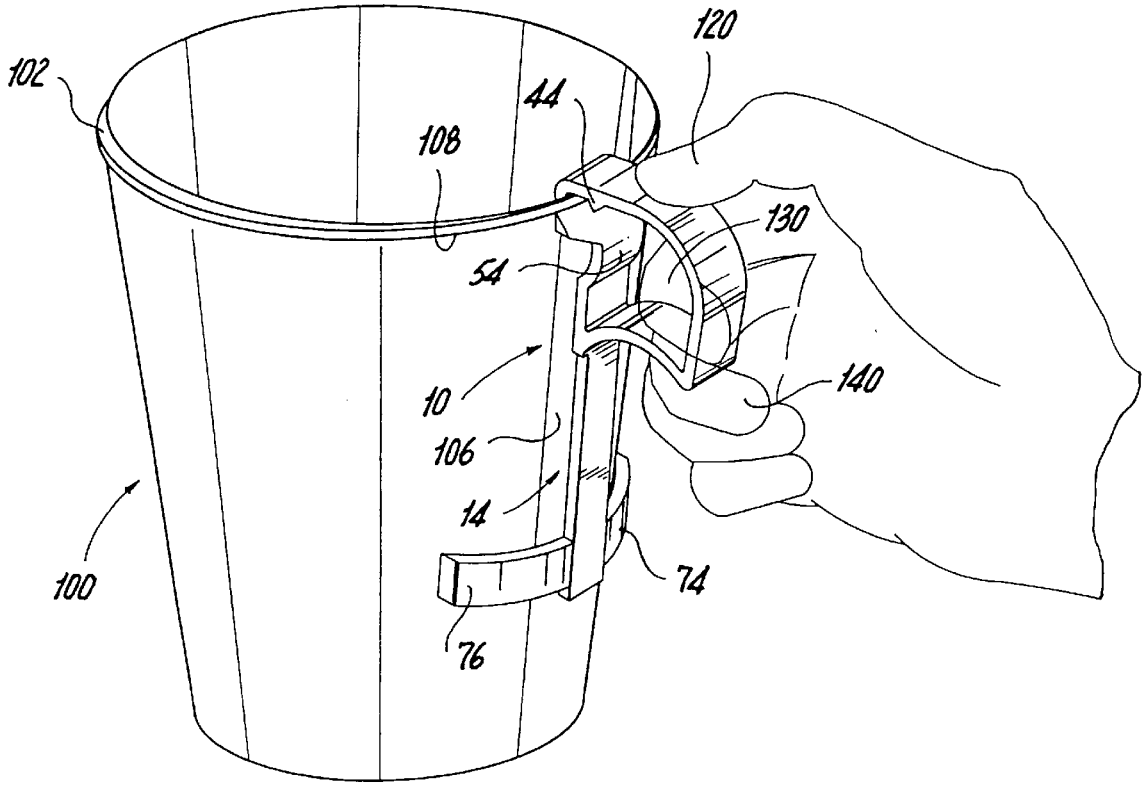
FIG. 5 is a perspective view of the detachable cup handle of FIG. 1 in an attached state to a cup.
Figure 6:
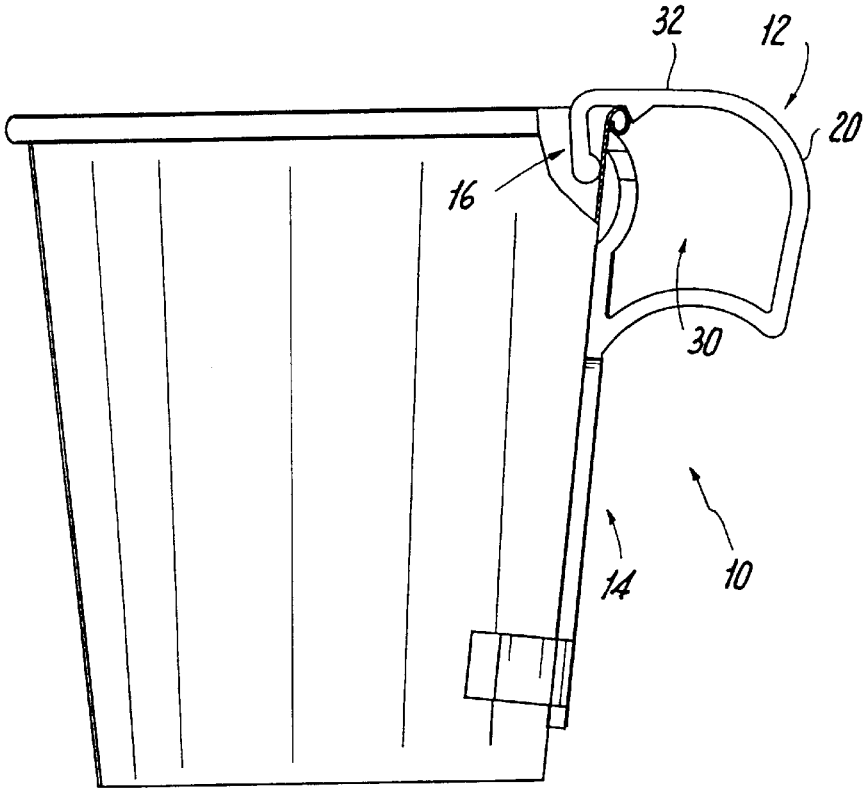
FIG. 6 is a side elevational view of the detachable cup handle attached to the cup as in FIG. 5.
Figure 7:
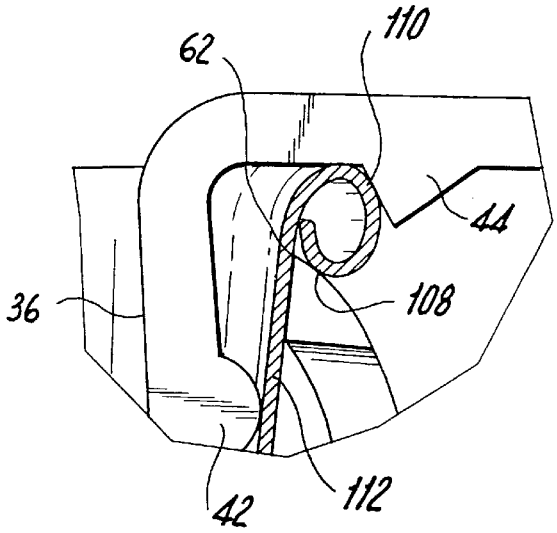
FIG. 7 is an enlarged view showing the rim of the cup retained between a top edge of an arched clamping wall portion of a support section and a transverse rib of a retainer section of the detachable cup handle.

As best shown in FIGS. 1, 2 and 4, the clamping wall portion 54 has a varying cross-section in that a lower portion 56 of the clamping wall portion 54 is generally of the same cross-sectional width as the adjacent portion of the first section 50 of the support section 14, while an upper portion 58 of the clamping wall portion 54 has a cross-sectional width significantly greater than the lower portion 56. In other words, the clamping wall portion 54 outwardly tapers along its vertical axis from the lower portion 56 to the upper portion 58 forming a wing-shaped bracket. The outwardly tapered construction of the clamping wall portion 54 results in a pair of opposing beveled support edges 60 being formed. The tapered wing-shaped construction of the upper portion 58 has a cross-sectional width that is significantly greater than a width of the upper support surface 32 and the vertical wall 36. The upper portion 58 terminates in an upper clamping edge 62. For purposes of illustration only, the length of the upper clamping edge 62 of the upper portion 58 can be on the order of twice as great as the cross-sectional width of the upper support surface 32. In other embodiments, the length of the upper clamping edge 62 can be more than twice the width of upper support surface 32 or less than twice the width of the width of the upper support surface 32.

The clamping wall portion 54 includes a front side 64 spaced from the vertical wall 36 of the retainer section 16 by a first clamping gap 66 and a rear side 68 that faces the transverse rib 44 of the retainer section 16 with a second clamping gap 70 being formed therebetween.

The second section 52 of the support section 14 includes a vertical support member 72 as well as a first arcuate support member 74 and a second arcuate support member 76. The first and second arcuate members 74, 76 are not planar support members but rather are outwardly curved along their respective lengths such that the first and second arcuate members 74, 76 curve outwardly away from the vertical support member 72 so as to form a latitudinal cross-bar. As will be described in greater detail hereinafter, the first and second arcuate members 74, 76 are constructed to have shapes complementary to the peripheral shape of the cup body. Accordingly, because most cups have a circular peripheral shape, the members 74, 76 each have an arcuate shape to permit the members 74, 76 to preferably seat flush against the circular cup body or at least be closely adjacent the cup body. Advantageously, these arcuate support members 74, 76 serve to disperse any load that is applied to the vertical support member 72 and also provide the detachable cup handle 10 with cradling means for engaging and securing the cup to the detachable cup handle 10.

This latitudinal cross-bar (first and second arcuate support members 74, 76) provides additional support to the detachable cup handle 10 and disperses the load more effectively when the user performs a drinking action and raises and tips the cup or otherwise moves the cup using the handle 10. When the user grips the detachable cup handle 10 and raises and tips the cup, a load is placed on the support section 14. By providing the latitudinal cross-bar, the load can be dispersed from the vertical support member 72 and spread over a greater area. This eliminates the risk that too great a load will be applied to the vertical support member 72 resulting in increased risk that such member 72 will fail.

The latitudinal cross-bar also acts as a support member for the detachable cup handle 10. When a drinking action is performed, the cup is typically titled at an angle. When the cup is tilted at this angle, a force is directed in the direction of the tilt due to the weight and flow of the fluid contained in the cup. The support section 14 bears this force and therefore, the first and second arcuate support members 74, 76 provide cup support by intimately engaging the body of the cup. In one embodiment, the combined arcuate length of the first and second arcuate support members 74, 76 is greater than a length of the second section 52. In order for the first and second arcuate support members 74, 76 to properly engage the cup, the degree of arcuate curvature for each of the first and second arcuate support members 74, 76 should be the same.

The first section 50 of the support section 14, especially the clamping wall portion 54 thereof, acts as a resilient arm that can be flexedly moved both toward and away from the rear face of the curved wall 20. The curved wall 20 is also a resilient member that can easily be flexed in variety of directions during a clamping action when the detachable cup handle 10 is secured to the cup.

Referring now to FIGS. 1 through 7, when in use, the detachable cup handle 10 is fastened to a cup 100, e.g., a disposable cup, by first inserting a rim 102 of the cup 100 into the first clamping gap 66 between the front side 64 of the arched clamping wall portion 54 and the vertical wall 36 of the retainer section 16, permitting the support section 14 to be seated against or closely adjacent to the periphery of the body 106 of the cup 100. When the detachable cup handle 10 fully engages and is secured to the cup 100, the top clamping edge 62 of the arched clamping wall portion 54 of the support section 14 abuts a bottom side 108 of the cup rim 102; the transverse rib 44 abuts an outer side 110 of the rim 102; and the clamping rib 42 of the vertical wall 36 of the retainer section 16 is clamped on an inner wall 112 of the cup 100. Because the upper portion 58 of the clamping wall portion 54 has the outwardly tapered construction, the upper clamping edge 62 has a greater width than other similar conventional cup holding devices and this results in the upper clamping edge 62 having an increased clamping surface area for engaging the bottom side 108 of the cup 100.

When holding the cup 100, the thumb 120 of the user is pressed on the planar upper portion 32 (which acts as a thumb rest portion) of the hand grip section 12; the forefinger 130 is inserted through the space 30, and the middle finger 140 is stopped at an outer side of the curved wall 20 or the middle finger 140 is placed against the lower surface of the arcuate wall 18.

The detachable cup handle 10 offers additional support and retainer features relative to similar conventional devices. By forming the clamping wall portion 54 with a tapered wing-shaped construction, additional cup gripping/clamping means is provided and results in the detachable cup handle 10 being securely fastened to the cup 100. Furthermore, additional support features are provided to the support section 14 of the detachable cup handle 10 for dispersing the load that is applied to the support section 14. In other words, the load is dispersed over a greater area of the cup body 106 and the first and second arcuate support members 74, 76 also serve to locate the cup 100 relative to the detachable cup handle 10 so that the detachable cup handle 10 securely engages and is fastened to the cup 100 at a predetermined location.

It will be appreciated by persons skilled in the art that the present invention is not limited to the embodiments described thus far with reference to the accompanying drawing. Rather the present invention is limited only by the following claims.

What is claimed:

1. A detachable cup handle adapted for fastening to a rim of a cup for carrying the cup by hand, the detachable cup handle comprising:

a hand grip section, a retainer section integrally connected to the hand grip section and a support section integrally connected to the hand grip section;

the hand grip section including an arcuate wall having first and second ends and a resilient curved wall having first and second ends, the first end of the arcuate wall being integrally connected to a portion of the support section, the second ends of the arcuate wall and the resilient curved wall being integrally connected to one another;

the retainer section including a substantially vertical wall having a first end and a second end, the first end being integrally connected to the first end of the hand grip section, the second end having a clamping rib formed thereat, the retainer section further including a transverse rib formed on an inner surface of the resilient curved wall proximate to the first end thereof, a space being defined between the transverse rib and the clamping rib;

the support section including a substantially vertical support member having a first section extending above the arcuate wall and a second section extending below the arcuate wall, the first section including a resilient arched clamping wall portion that is received in the space, the resilient arched clamping wall portion having an outwardly tapered construction at an upper portion thereof so as to form an elongated top clamping edge, the top clamping edge having a length substantially greater than a width of the transverse rib, the support section further including opposing arcuate support members extending latitudinally from the substantially vertical support member of the second section.

2. The detachable cup handle of claim 1, wherein the hand grip section, retainer section and support section are integrally formed of a single plastic material.

3. The detachable cup handle of claim 1, wherein the resilient arched clamping wall resiliently flexes between a rest position and an applied position when the detachable cup handle is secured to the cup, wherein in the rest position, there is a first gap between a front side of the arched clamping wall and the substantially vertical wall and a second gap between a rear side of the arched clamping wall and the transverse rib.

4. The detachable cup handle of claim 3, wherein in the applied position, the rear side seats against the transverse rib.

5. The detachable cup handle of claim 1, wherein the length of the top clamping edge is greater than a width of the arcuate wall at the first end such that the top clamping edge extends beyond side edges of the arcuate wall.

6. The detachable cup handle of claim 1, wherein each of the opposing arcuate support members has the same degree of curvature.

7. The detachable cup handle of claim 1, wherein at least a portion of the clamping rib is disposed below a point where the clamping wall portion begins to outwardly taper.

8. The detachable cup handle of claim 1, wherein the outwardly tapered construction includes a pair of beveled edges.

9. The detachable cup handle of claim 1, wherein the opposing arcuate support members are formed at a lowermost end of the second section of the support section.

10. The detachable cup handle of claim 1, wherein the outwardly tapered construction terminates with the top clamping edge.

11. The detachable cup handle of claim 1, wherein the tapered construction includes outwardly tapered opposing beveled edges that terminate in opposing side edges that are parallel to one another, the top clamping edge being formed at upper ends of the opposing side edges.

12. The detachable cup handle of claim 1, wherein the length of the top clamping edge is at least twice as great as the width of the transverse rib.

13. The detachable cup handle of claim 1, wherein the length of the top clamping edge is at least twice as great as a width of the first end of the arcuate wall.

14. The detachable cup handle of claim 1, wherein the length of the top clamping edge is greater than a width of the arcuate wall at the first end thereof such that the top clamping edge extends beyond side edges of the arcuate wall.

15. The detachable cup handle of claim 1, wherein an arcuate length of the combined first and second arcuate support members is greater than a length of the second section of the support section.

16. A detachable cup handle adapted for fastening to a rim of a cup for carrying the cup by hand, the detachable cup handle comprising:

a hand grip section, a retainer section integrally connected to the hand grip section and a support section integrally connected to the hand grip section;

the hand grip section including an arcuate wall having first and second ends and a resilient curved wall having first and second ends, the first end of the arcuate wall being integrally connected to a portion of the support section, the second ends of the arcuate wall and the resilient curved wall being integrally connected to one another;

the retainer section including a substantially vertical wall having a first end and a second end, the first end being integrally connected to the first end of the hand grip section, the second end having a clamping rib formed thereat, the retainer section further including a transverse rib formed on an inner surface of the resilient curved wall proximate to the first end thereof, a space being defined between the transverse rib and the clamping rib;

the support section including a substantially vertical support member having a first section extending above the arcuate wall and a second section extending below the arcuate wall, the first section including a resilient arched clamping wall portion that is received in the space, the resilient arched clamping wall portion having an outwardly tapered construction at an upper portion thereof so as to form an elongated top clamping edge, the top clamping edge having a length substantially greater than a width of the transverse rib.

17. The detachable cup handle of claim 16, wherein the resilient arched clamping wall resiliently flexes between a rest position and an applied position when the detachable cup handle is secured to the cup, wherein in the rest position, there is a first gap between a front side of the arched clamping wall and the substantially vertical wall and a second gap between a rear side of the arched clamping wall and the transverse rib.

18. The detachable cup handle of claim 17, wherein in the applied position, the rear side seats against the transverse rib.

19. The detachable cup handle of claim 16, wherein the length of the top clamping edge is greater than a width of the arcuate wall at the first end such that the top clamping edge extends beyond side edges of the arcuate wall.

20. The detachable cup handle of claim 16, wherein at least a portion of the clamping rib is disposed below a point where the clamping wall portion begins to outwardly taper.

21. The detachable cup handle of claim 16, wherein the outwardly tapered construction includes a pair of beveled edges.

22. The detachable cup handle of claim 16, wherein the outwardly tapered construction terminates with the top clamping edge.

23. The detachable cup handle of claim 16, wherein the tapered construction includes outwardly tapered opposing beveled edges that terminate in opposing side edges that are parallel to one another, the top clamping edge being formed at upper ends of the opposing side edges.

24. The detachable cup handle of claim 16, wherein the length of the top clamping edge is at least twice as great as the width of the transverse rib.

25. The detachable cup handle of claim 16, wherein the length of the top clamping edge is at least twice as great as a width of the first end of the arcuate wall.

26. The detachable cup handle of claim 16, wherein the length of the top clamping edge is greater than a width of the arcuate wall at the first end thereof such that the top clamping edge extends beyond side edges of the arcuate wall.

27. The detachable cup handle of claim 16, wherein the hand grip section, retainer section and support section are integrally formed of a single plastic material.

* * * * *